United States Patent [19]

Tonali

[11] Patent Number: 4,656,954

[45] Date of Patent: Apr. 14, 1987

[54] AUTODIRECTING SECURITY ENTRANCE FOR BANKS AND THE LIKE

[75] Inventor: Roberto Tonali, Faggeto Lario, Italy

[73] Assignee: Tonali S.p.A., Milan, Italy

[21] Appl. No.: 762,778

[22] Filed: Aug. 6, 1985

[30] Foreign Application Priority Data

Aug. 8, 1984 [IT] Italy ..... 22267 A/84

[51] Int. Cl.[4] ..... E05G 5/02

[52] U.S. Cl. ..... 109/6

[58] Field of Search ..... 109/3, 6, 8

[56] References Cited

U.S. PATENT DOCUMENTS 4,060,039 11/1977 Lagarrigue ..... 109/8

FOREIGN PATENT DOCUMENTS 2295504 7/1976 France .

1496481 12/1977 United Kingdom .

*Primary Examiner*—James L. Ridgill, Jr.

*Attorney, Agent, or Firm*—Fleit, Jacobson, Cohn & Price

[57] ABSTRACT

This security entrance is of the box-type with interlocked doors, and comprises an armoured vestibule having one door communicating with the bank and one door communicating with the exterior; a third door can be opened into a discharge space separate from the bank. This third door is controlled by a metal detector of known type.

2 Claims, 3 Drawing Figures

AUTODIRECTING SECURITY ENTRANCE FOR BANKS AND THE LIKE

BACKGROUND OF THE INVENTION

The present invention relates to a box-type security entrance with interlocked doors, for banks and the like.

Among the preventive defense measures against crime, box-type security entrances with interlocked doors are having ever greater success in banks and all buildings exposed to the risk of robbery.

It is surely unnecessary to dwell on the well known reasons for this success. It is wished here to draw attention to the fact that, by virtue of these boxes, one controller alone can ensure very high security for the bank.

In fact, if a criminal were to attempt to enter the bank with a weapon, a metal detector would prevent the opening of one of the two entrance doors to the bank, stopping the criminal from entering and at the same time giving the alarm to a controller in a kiosk adjacent the box.

Of course, the presence of an armed criminal is not the only possible cause of triggering of the alarm, indeed in most cases the alarm is set off by accident or due to the presence of harmless metal bodies. It is the duty of the controller to evaluate the situation and decide how to behave.

The typical behaviour of the controller is that of ascertaining first of all whether the user who has caused the alarm is a person who is known and trustworthy; if that is the case, the controller unlocks the system and allows the user to enter.

If the user who has caused the alarm does not give sufficient assurance (or if the regulations of the bank are that the system is not to be unlocked regardless of who the person involved might be), the controller proceeds with the checking which is usually carried out in the following manner.

The controller invites the user to turn round and possibly leave metal objects which may have caused the alarm in a suitable security locker. The user then leaves the box by the door through which he had entered and repeats the passage through the metal detector.

From what has been explained, there is clearly a problem connected with the use of boxes with interlocked doors. This problem is the extreme delicacy of the controller's task. The security of the bank is in fact entrusted to his sensitivity and loyalty. Moreover the fact that he is the only one to have such a responsibility could even involve him in complicity with criminals.

In order to eliminate this danger, the general trend is to replace the controller by automatic devices of various types. For example, the possibility has been studied of providing the box with a recorder or preferably a voice synthesizer, and an automatic resetting system. In the event of an alarm, the voice synthesizer comes into operation and invites the user to turn round and deposit any metal objects. When the user has left the box, an automatic system cancels the alarm and puts it back into operation.

This solution is not entirely satisfactory however. In fact, in the event of an alarm, it could cause considerable chaos in the flow of users. It has in fact been tried in various fields that the average reaction time of a person confronted with an artificial voice which invites him to carry out an unexpected operation (quite contrary to that which the person expected to do) are very long, such as almost to require at least one repetition of the message.

The consequences of an alarm at peak times are easily imaginable: if the user who has caused the alarm is not quick, there is the risk that the entrance to the bank will remain blocked for a long time.

Another proposal studied is that of providing revolving sector doors in which the alarm causes the reversal of the sense of rotation; the user who has caused the alarm is thus returned to the exit. With this proposal, however, it is clear that, although the exit time of the user is predetermined, it does not in fact avoid a certain confusion; indeed it is easy for other users also to be involved in the reverse movement with obvious discomfort. It is also possible that, during the stoppage, a user who has nothing to do with the alarm may remain trapped and have to wait for the situation to normalize.

It is thus clear that the solutions proposed until now cannot be used in practice since they would risk complicating matters to such an extent as to make entry to the bank disagreeable to the users.

There is thus a problem of affording maximum security to a bank (independently of subjective factors) preventing that any alarm creates obstacles such as seriously to disturb the normal flow of users.

SUMMARY OF THE INVENTION

The idea for a solution is that of taking the user who has caused the alarm out of the normal path of entry.

On the basis of this idea and in accordance with the present invention, the above problem is solved by a security entrance of the aforesaid type which includes a further door that can be opened into a space separate from the bank.

To advantage, this further door is controlled by a metal detector of known type.

BRIEF DESCRIPTION OF THE DRAWINGS

Further characteristics and advantages of a security entrance according to the invention will become more apparent from the following description of two preferred embodiments, given with reference to the appended drawings. In these drawings.

DESCRIPTION OF TWO PREFERRED EMBODIMENTS

Figure 1:
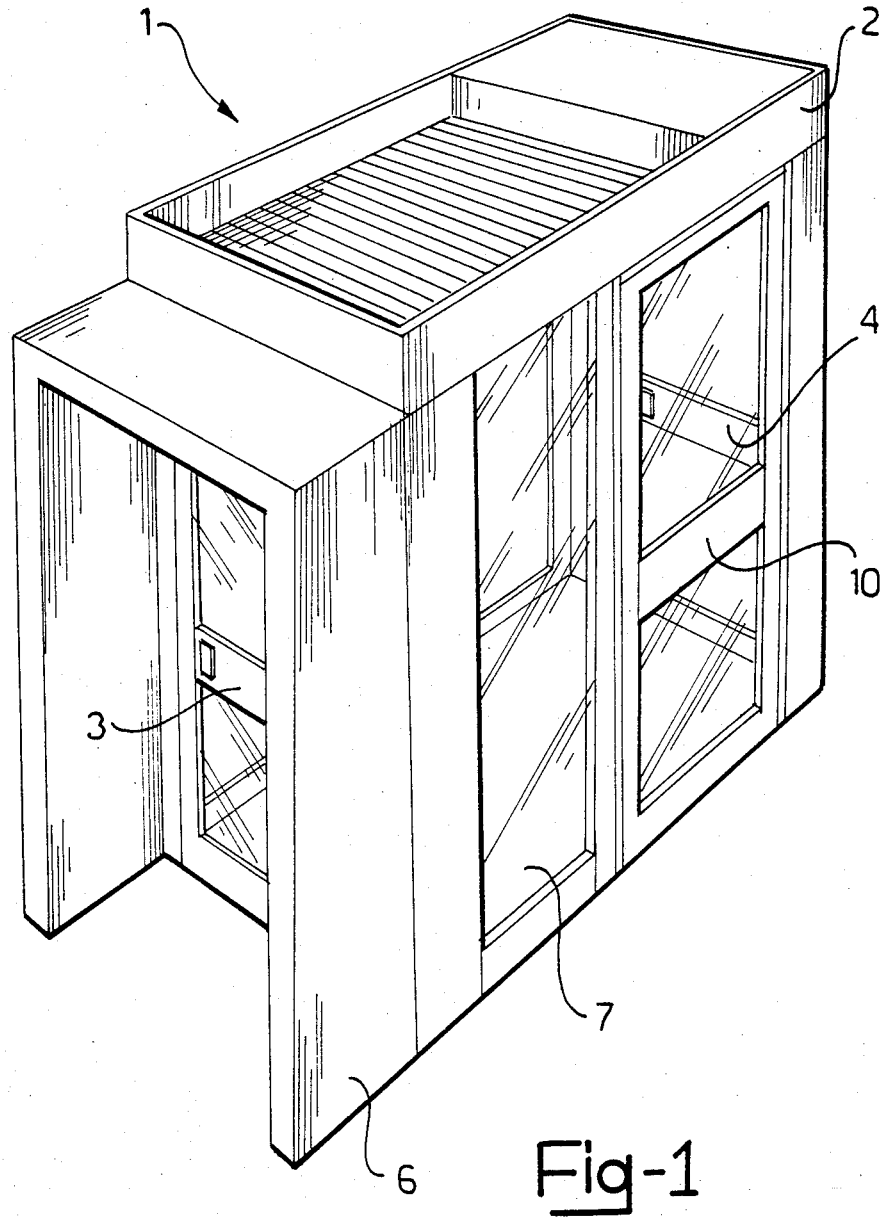
FIG. 1 is a perspective view of a security entrance according to a first embodiment of the invention.

An environment to be protected, for example a bank B, is provided with a security entrance, generally indicated 1, which allows access to the bank B from the exterior E.

The entrance 1 is of the so-called box type with interlocked doors, and comprises an armoured vestibule 2 (also called a box) provided with a door 3 for entry to the vestibule 2 from the exterior E and a door 4 for entry to the bank B from the vestibule 2.

The entrance 1 also includes a metal detector 6 disposed, for example, as a portal outside the entrance door 3 to the vestible 2, so that it must be passed through to enter the vestibule 2.

In the vestibule 2 is a person or object detector; this detector may be of any of the various known types, for example a gravimetric platform 7 extending across the entire base of the vestibule 2.

The entrance 1 also includes a further door 10 in the vestibule 2 which can be opened into a discharge space D separate from the bank B and communicating with the exterior E. To advantage, the door 10 is controlled by the metal detector 6 as will be better explained below.

The functioning of the entrance 1 will now be described starting from an initial condition in which the vestibule 2 is empty, the doors 4 and 10 are locked, and the door 3 is unlocked.

Users who wish to enter the bank pass through the metal detector 6, open the door 3 and enter the vestibule 2. Their presence in the vestibule 2 causes the locking of the door 3 once closed. At this point, there are two possible procedures.

When the detector 6 has not sensed the presence of weapons or other metal objects during the passage of the users, the door 4 is unlocked and the users can enter the bank B. After the users have left the vestibule 2 and the door 4 has been closed, the door 4 is locked and the door 3 unlocked, restoring the initial condition.

In the case in which the detector 6 has sensed the presence of metal objects during the passage of the users, the alarm procedure is set off; the door 4 remains locked while the door 10 is unlocked and the users can go into the discharge space D. After the users have left the vestibule 2 and the door 10 has closed, the door 10 is locked, the metal detector 6 is reset and the door 3 is unlocked, returning to the initial condition.

Meanwhile, once they are in the discharge space D, the users who caused the alarm are invited by suitable announcements to re-present themselves at the entrance after having placed any metal objects in a suitable security locker A in the discharge space D. In the meantime, the entry of other users may proceed without hindrance.

It will be noted that the entrance according to the invention does not require the presence of a controller. This entrance is entirely self-sufficient in that its operation is entirely automatic. Notwithstanding this it never creates situations of particular embarrassment for the users, even in the case of alarms.

In fact, the user never has to turn back but simply has to choose between two doors which are practically in front of him. To direct the choice suitable indicator lights could be provided; for example, two signals may be associated with each door, one red and one green, the lighting of which are related to the door-locked and door-unlocked conditions respectively. In an improved embodiment even the doors may be of the automatic opening type.

Naturally, other embodiments of the invention different from that described may be provided.

Figure 3:
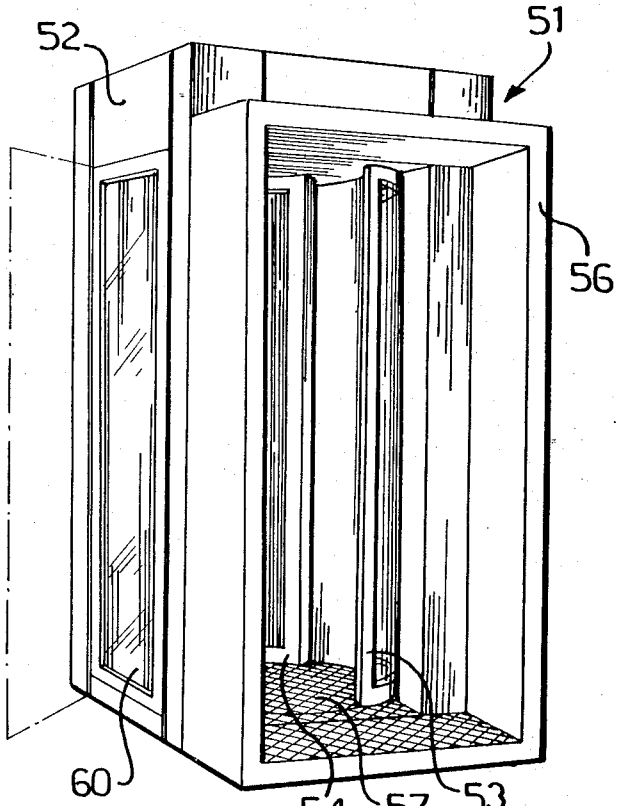
FIG. 3 is a perspective view of a security entrance according to a second embodiment of the invention.
Figure 2:
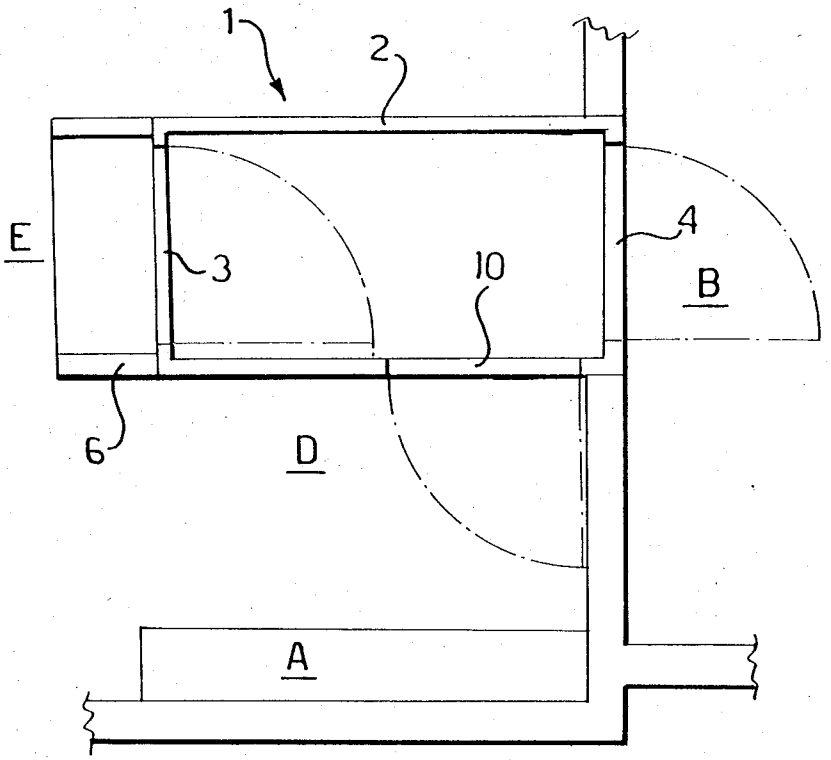
FIG. 2 is a schematic plan view of the security entrance of FIG. 1.

One example is illustrated in FIG. 3. In this case, an entrance 51 has a vestibule 52 which has a substantially cylindrical interior for receiving only one person at a time. The vestibule 52 has automatic sliding doors 53, 54 of curved shape, which communicate with the exterior and with the bank respectively. Like the entrance 1, the entrance 51 includes a metal detector 56, a gravimetric platform 57, and a door 60 communicating with a discharge space outside the bank.

The operation of the entrance 51 is quite similar to that of the entrance 1, with the sole difference that it does not allow the passage of more than one person at a time, both because of the smaller dimensions of the vestibule 52 and particularly because the gravimetric platform 57 initiates the alarm procedure when it senses a weight greater than a predetermined value.

Other embodiments are also possible according to the different specific requirements of the bank, for example, the placing of the metal detector within the vestibule or the possibility of using the same vestibule for both entrance and exit, without thereby departing from the scope of protection of the following claims.

I claim:

1. A security entrance for separating a protected room from an exterior free space, said security entrance comprising:

a vestibule;

a first door means interconnecting said vestibule with the exterior free space;

a second door means interconnecting said vestibule with the protected room; and a third door means interconnecting said vestibule with a discharge space, said discharge space being separate from the protected room and said discharge space communicating with the exterior free space, one of said second door means and said third door means being opened after passage of a person into said vestibule through said first door means from the exterior free space.

2. A security entrance according to claim 1, wherein said third door means is controlled by a metal detector to open said third door means to the discharge space and to lock said first door means and second door means, if metal is detected passing through said first door means.

* * * * *